United States Patent [19]

Alcock et al.

[11] Patent Number: 4,795,359

[45] Date of Patent: Jan. 3, 1989

[54] ELECTRICAL CONNECTOR

[75] Inventors: John M. Alcock, Ulverston; Joseph A. Nocholson, Broughton-in-Furness, both of Great Britain

[73] Assignee: Tronic Electronic Services Limited, Ulverston, England

[21] Appl. No.: 65,833

[22] Filed: Jun. 23, 1987

[30] Foreign Application Priority Data

Jun. 23, 1986 [GB] United Kingdom ..... 8615272
Nov. 11, 1986 [GB] United Kingdom ..... 8626901

[51] Int. Cl.[4] ..... H01R 13/52

[52] U.S. Cl. ..... 439/271; 439/201; 439/205

[58] Field of Search ..... 439/271–283, 439/519, 586, 587, 624, 933, 936, 190, 197, 199, 201, 205, 206, 521, 140, 141, 142

[56] References Cited

U.S. PATENT DOCUMENTS 3,241,095 3/1966 Phillips ..... 439/205
4,039,242 8/1977 Wilson et al. ..... 439/199
4,174,875 11/1979 Wilson et al. ..... 439/190
4,192,569 3/1980 Mucci ..... 439/201
4,479,690 10/1984 Inouye et al. ..... 439/275
4,589,717 5/1986 Pottier et al. ..... 439/277

FOREIGN PATENT DOCUMENTS 1202374 10/1965 Fed. Rep. of Germany ..... 439/440

*Primary Examiner*—David Pirlot
*Attorney, Agent, or Firm*—Chilton, Alix & Van Kirk

[57] ABSTRACT

An underwater electrical connector comprises male and female parts which are brought together to make an electrical connection. The female part includes first, second and third closed chambers containing electrically insulating media, the second chamber being located within the first, and the third chamber being located within the second. An electrically insulating shuttle piston extends through a contact socket disposed in the third chamber and through respective aligned openings of the three chambers. The shuttle piston is arranged to be urged back by a contact pin of the male part of the connector during insertion thereof such that the contact pin is received and directly engaged by the contact socket in the third chamber to effect the electrical connection.

9 Claims, 3 Drawing Sheets

Fig. 1.
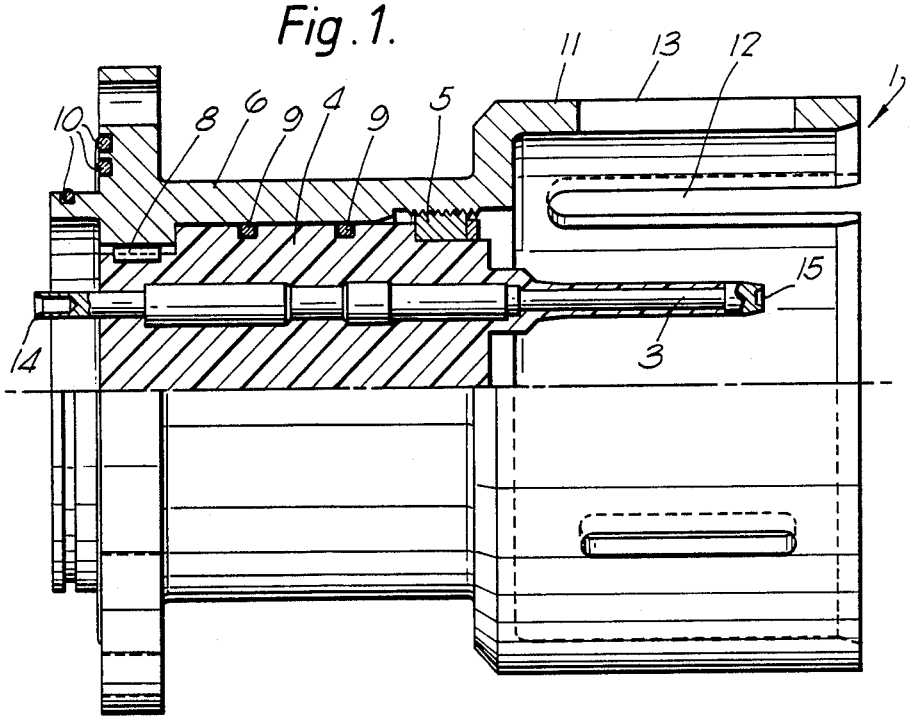
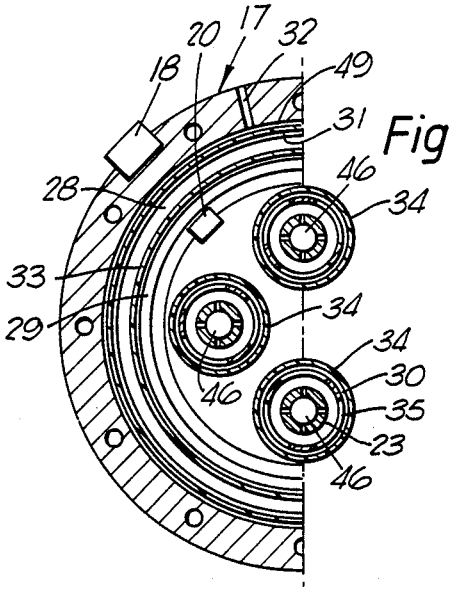
Fig. 3.

ELECTRICAL CONNECTOR

The invention relates to an underwater electrical connector comprising male and female parts which are brought together to make an electrical connection.

Underwater electrical connectors are known in which the female part has an electrical contact disposed within a closed chamber filled with an insulating grease or oil to provide a protected area around the contact where a connection is to be made. It has been proposed in U.S. Pat. No. 3,729,699 to provide the oil filled chamber with an opening which is sealed by a spring biased slidable shuttle piston arranged to be pushed back by engagement of a projecting male contact pin with the piston. By thus providing a shuttle piston, very little, if any, distortion of the opening is required, and the opening can be quite large to permit large pin diameters for heavy current and/or a multiservice arrangement such as coaxial connection.

The opening of the chamber is closed either by the shuttle piston in the unmated condition of the connector or by the male contact pin when the male and female parts of the connector are brought together. A seal for the opening is provided in the form of a pair of spaced O-rings for engaging the shuttle piston or the contact pin, depending on which of these extends through the opening. With this arrangement there is a risk of deterioration of the seal which may result in water or contaminants entering the chamber where the electrical connection is made.

According to the invention there is provided an underwater electrical connector comprising male and female parts, the male part having a contact pin and the female part having contact means within or inwardly of a chamber containing electrically insulating media, the chamber being provided with an opening normally closed in sealing manner by a resiliently biased shuttle piston which extends through the opening and is arranged to be engaged and urged back by the contact pin during insertion thereof to cause an electrical connection to be made with the contact means of the female part, wherein the female part has first and second closed chambers containing electrically insulating media and each provided with a respective opening, the openings being aligned and normally sealed by the shuttle piston extending therethrough, the second chamber being located within or inwardly of the first chamber and the contact means being located within or inwardly of the second chamber.

With such an arrangement, if for example the quality of the seal of the first chamber opening deteriorates and allows entry of water or contaminants, then the provision of a second closed chamber located within or inwardly of the first ensures that the region where the contact means is located is not contaminated. Thus a reliable, electrically insulated electrical connection can be ensured. The electrical insulating media in the chambers will generally be a dielectric fluid such as oil, grease or the like.

The electrical integrity of the two chamber connector can be further improved by providing a third chamber containing electrical insulating media and located within or inwardly of the second chamber, the third chamber having an opening aligned with the other openings and normally sealed by the shuttle piston extending therethrough, the contact means being located within the third chamber. In the event of breakdown of the sealing of the openings to the first and second chambers, then the third chamber provides further protection for the region where the electrical connection is made.

The shuttle piston might have a conducting portion which is engaged by the contact pin and which engages the contact means within or inwardly of the second chamber when the piston is pushed back, thereby completing the electrical connection. However, the shuttle piston is preferably formed of electrically insulating material and extends through a female contact socket located within or inwardly of the second chamber, whereby the electrical connection is made by the contact pin pushing back the shuttle piston to be received and directly engaged by the contact socket. This arrangement, while providing the advantages of a shuttle piston referred to above, avoids the need for a double electrical connection i.e. that between the contact pin and the piston and that between the piston and the female contact means.

Since the contact socket is provided within a chamber containing electrically insulating media, it can be "live" prior to and during mating of the male and female parts of the connector.

It is desirable that the connector can withstand high pressures so that it can be used underwater at depth. Thus, the connector may include means for effecting balancing of the media pressure in the respective chambers relative to the pressure outside the connector. This can be done by making the chambers containing insulating media variable in volume so as to adapt to pressure changes and thus inhibit the entry of water through the respective openings. This may be achieved by means of a piston or the like, but preferably each chamber has a wall formed at least partly of a flexible membrane arranged to permit variation of the respective chamber volume. The flexible membrane may be formed as part of the same member which normally seals the chamber opening, or it may be provided separately at a convenient location.

The normally sealed openings of the first and second chambers are generally formed in respective front walls thereof, and in one preferred embodiment each chamber has a flexible membrane in a side wall thereof, the membrane of the second chamber being laterally inwardly spaced from the side wall of the first chamber. Thus, in this embodiment the second chamber is defined within the first. In this arrangement the first chamber membrane is arranged to be exposed to the pressure of ambient water while the second chamber membrane is exposed to the pressure of media in the first chamber. If a third chamber is provided this can also have a flexible membrane in a side wall thereof laterally inwardly spaced from the second chamber side wall.

In another embodiment in which the normally sealed openings are formed in respective front walls of the chambers, the chambers share a common outer side wall, the second chamber being located inwardly of the first. A flexible membrane for each chamber might then be provided in the outer wall, each membrane being exposed to the pressure of ambient water, but preferably the flexible membranes are provided in the respective front walls.

The male part of the connector may include a slidably mounted wiper seal engaging the contact pin and resiliently biased towards the contact end thereof, the seal being arranged to be moved back over the pin during mating of the male and female parts. The wiper seal may, for example, be mounted by a slidable piston which defines the forward end of a chamber for the contact pin.

The male part of the connector may be provided with a single contact pin or it may have a plurality of pins with the female part having the same number of contact means. Preferably four or more contact pins are provided, and they might for example be uniformly spaced around the central longitudinal axis of the connector. If a third chamber is provided it might enclose all the female contact means collectively, but preferably each contact means corresponding to a respective contact pin is separately enclosed by an individual third chamber.

Certain preferred embodiments of the invention will now be described by way of example and with reference to the accompanying drawings in which:

FIG. 1 is a partly sectioned side elevation of the male part of an electrical connector;

FIG. 3 is a part section on the lines 3—3 of FIG. 2;

Figure 2:
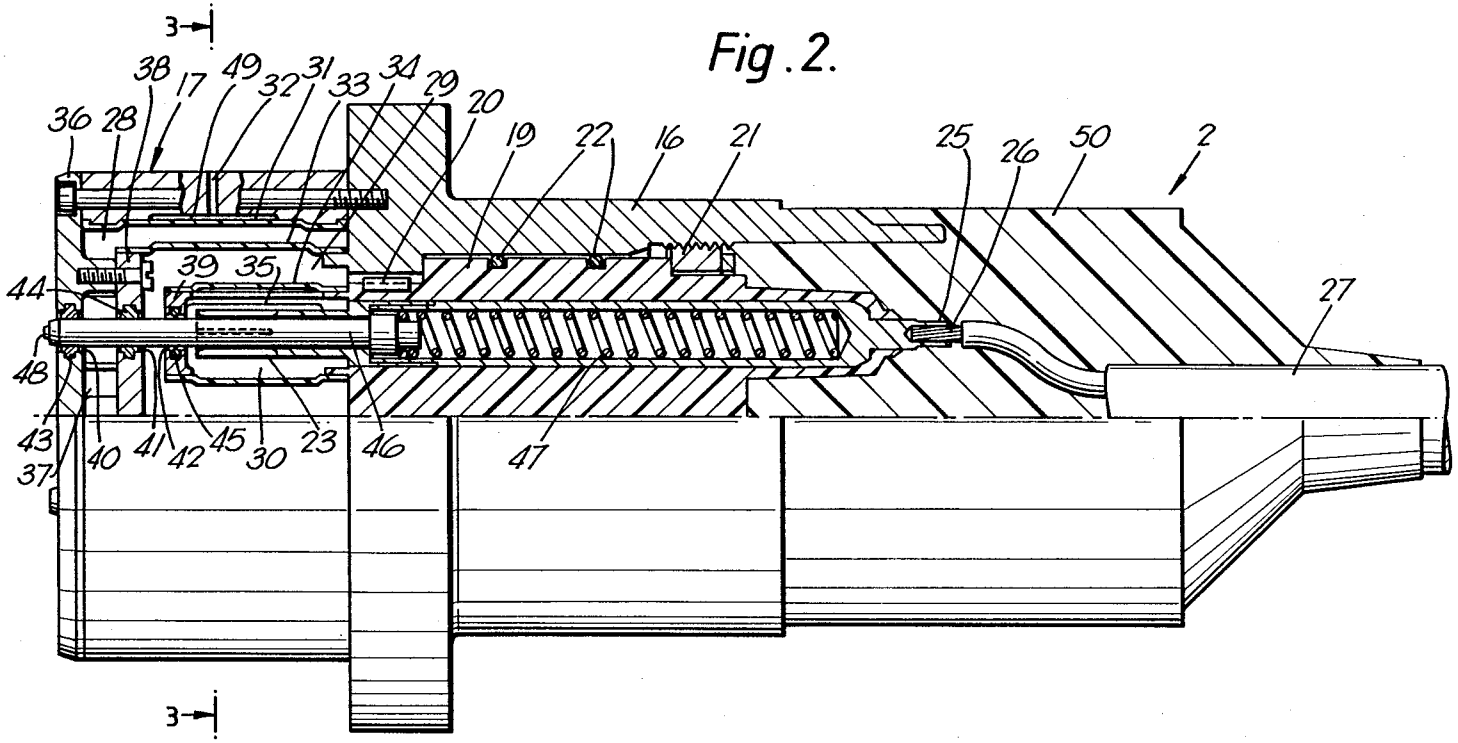
FIG. 2 is a partly sectioned side elevation of the female part of the connector.

The electrical connector basically comprises a male part 1 to be connected underwater with a female part 2. Referring firstly to FIG. 1, the male part 1 includes four projecting contact pins 3 bonded to an insert 4 held by a retaining ring 5 in a connector socket 6. The connector socket may be moulded or it may be fabricated e.g. by machining to the correct size and shape. The insert 4, which may be formed of epoxy resin or other suitable insulating material, is correctly located by means of a key and key-way 8 at its rear end and is sealed to the connector socket 6 by a pair of insert O-rings 9. The connector socket is provided with three bulkhead seals 10 to ensure sealed engagement with a bulkhead. At its forward end the connector socket has an outer shroud 11 surrounding the four contact pins and having a key-way 12 for accurate mating with the nose of the female connector part 2. Slots 13 are provided for displacement of water as the outer shroud 11 receives the nose of the female part. The contact pins are each provided at the rear end with a solder cup 14 for connection with a respective conductor and at the front end with a cone-shaped recess 15 for positive engagement with a corresonding projection of the female part during mating.

Referring to FIGS. 2 and 3, the female part 2 of the connector includes a connector plug 16 to which is secured a nose 7 having a key 18 for engagement with the key-way 12 of the male part during mating. Other location/guidance arrangements could be used. Similarly to the arrangement of the connector socket 6 of male part 1, the connector plug 16 is provided with an e.g. epoxy resin insert 19 located by a key and key-way 20 and held by a retaining ring 21, the insert being sealed to the connector plug by a pair of O-rings 22. Four tubular contact sockets 23 are bonded within the insert 19 and are each provided at the rear end with a solder cup 25 for connection with a respective conductor 26 of a cable 27. Alternatively, a crimped or other type of connection might be used. The connection is encased in a polyurethane moulding 50 bonded to the connector plug 16, the insert 19 and the cable 27. The female part of the connector could also be provided in a form which is more readily installable on site.

At their forward ends the tubular contact sockets 23 project into the connector plug nose 17. Within the nose 17 are defined a first outer chamber 28, a second chamber 29, and four individual third or inner chambers 30 each enclosing the projecting end of a respective contact socket 23. All the chambers are filled with insulating media such as a dielectric fluid e.g. oil, grease or the like. The first chamber 28 has an annular outer wall comprising a flexible membrane 31 the outer surface of which is vented to the outside by a pressure compensating vent hole 32. This ensures that when the connector is submerged and is subject to increasing pressures, the membrane deflects inwardly to decrease the volume of the chamber and so balance the pressure. In this way any tendency for water from the outside to enter the chamber is reduced. An annular space 49 around the outside of the membrane 31 allows dielectric fluid displacement when the contact pins enter the chambers during mating. The second chamber 29 is enclosed within the outer chamber 28 and is similarly provided with an annular flexible membrane 33. The individual inner chambers 30 also each have an annular flexible membrane 34, each carried by lantern type supports 35 projecting from the insert 19.

The first or outer chamber 28 is closed by a front plate 36 which has rearwardly projecting lugs 37 supporting a front plate 38 of the second chamber. The front plate 39 of each inner chamber 30 is supported by the lantern supports 35. The front plates 36, 38 and 39 of the respective chambers are respectively provided with openings 40, 41 and 42, each having an annular seal 43, 44 and 45. Referring to the arrangement associated with just one of the four inner chambers 30, a slidable shuttle piston 46 extends through the three aligned openings 40, 41 and 42 so as to close the chambers. In fact, the annular seal 45 of the inner chamber is an O-ring which has a slight clearance from the shuttle pin to reduce drag thereon, although the contact pin 3 is of larger diameter so that the seal 45 forms a close fit on the pin during mating. The shuttle pin is formed of an insulating material and is forwardly biased by a spring 47 retained within the contact socket 23. The front of the shuttle piston is formed as a cone-shaped projection 48 for positive engagement with the correspondingly shaped recess 15 of the male connector part.

To make the connection between the male and female parts of the connector the plug nose 17 is inserted into the outer shroud 11 while being guided by the mating key 18 and key-way 12. Each of the four contact pins 3 engages a corresponding shuttle piston 46 and pushes it back against the force of the spring 47. Each pin passes successively through the three aligned openings 40, 41 and 42 to be received in a contact socket 23 and thereby to complete the electrical connection.

Figure 4:
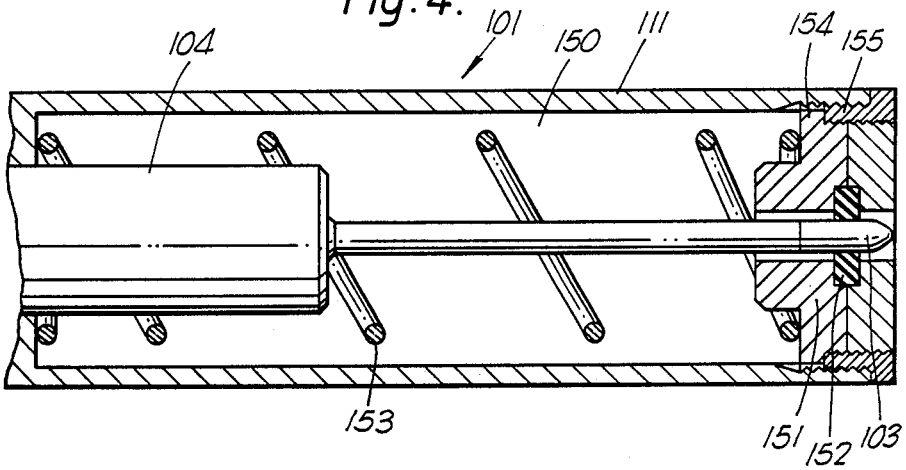
FIG. 4 is a section through the male part of a second embodiment of electrical connector.
Figure 5:
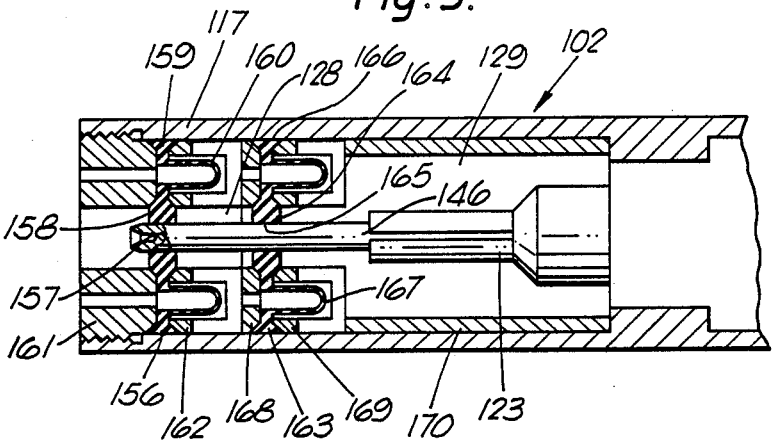
FIG. 5 is a section through the female part of the connector of FIG. 4.

FIGS. 4 and 5 respectively show male and female parts 101 and 102 of a second electrical connector. Referring firstly to FIG. 4 the male part 101 includes a single contact pin 103 projecting from an insert 104 and surrounded by an outer shroud 111 which defines a contact pin chamber 150. The forward end of the chamber 150 is closed by a piston 151 split into two parts which receive therebetween a wiper seal 152 engaging the outside of the contact pin. The piston is urged by a spring 153 to a forward position in which a radial projection 154 of the piston engages an abutment ring 155 secured on the end of the shroud 111. The piston is located in this forward position when the connector is in the unmated condition and the major length of the contact pin is then protected. When the male part 101 is mated with the female part 102 the piston 151 is pushed rearwardly and carries the wiper seal 152 which slides axially along the surface of the contact pin. On decoupling the connector, the spring 153 ensures that the piston and wiper seal return to the forward position, so that the contact pin chamber 150 is protected at all times from the entry of debris.

Referring to FIG. 5, the female connector part 102 includes a plug nose 117 in which is mounted a tubular contact socket 123 having a slidable shuttle piston 146 extending axially therethrough, as in the embodiment of FIGS. 1 to 3. Within the plug nose 117 are defined a first, outer chamber 128 and a second, inner chamber 129 which encloses the contact socket 123. The forward wall of the outer chamber comprises a one-piece closure member 156 having a central axial opening 157 through which the shuttle piston 146 extends. The closure member 156 is formed of a flexible material and has an inner ring seal 158 defining the opening 157 and an outer ring seal 159 in sealed engagement with the inside surface of the plug nose 117. The ring seals 158 and 159 are connected together by an integral, relatively thin, flexible membrane 160 of the closure member which is arranged to project rearwardly into the outer chamber 128 and to flex so as to allow volume changes thereof, similarly to membrane 31 of the first embodiment. The closure member 156 is retained in position on its forward side by a nut 161 having axial passages therethrough to communicate the outside of membrane 160 with ambient water pressure, and on its rear side by a cage support 162 which also serves to support the membrane.

A second closure member 163 separates the outer and inner chambers 128 and 129. The member 163 has an inner ring seal 164 defining an opening 165 for the shuttle piston, an outer ring seal 166 in sealed engagement with the inside surface of the plug nose 117, and an integral flexible membrane 167 connecting the ring seals together. The closure member is retained on its forward side by a washer 168 having axial holes therethrough to communicate the membrane 167 with the pressure in the outer chamber 128, and on its rear side by a cage support 169 which abuts against the forward end of a sleeve 170 disposed inside the plug nose 117.

To make the connection between the male and female parts 101 and 102 of the connector the plug nose 117 is inserted into the outer shroud 111. The piston 151 of the male part is pushed back by the nose 117 and the contact pin 103 pushes back the shuttle piston 146 to pass successively through the opening 157 to the outer chamber and the opening 165 to the inner chamber. The contact pin is received in the contact socket 123 to complete the electrical connection within the inner chamber.

Although the embodiment of FIGS. 4 and 5 has only one pin and socket, a plurality of such of such pins and sockets could be provided in a connector.

It is to be noted that in both embodiments the various chambers containing electrically insulating media are separate and sealed from each other, the only communication between adjacent chambers being provided by the openings through which either the shuttle piston passes in the unmated condition of the connector or the contact pin passes when the male and female parts of the connector are brought together.

Modifications to the broad aspects and the specific embodiment of the invention may be apparent to a person skilled in the art and it is intended that this disclosure should extend to any such modifications.

We claim:

1. An underwater electrical connector comprising male and female parts, the male part having a contact pin and the female part having contact means within a chamber containing electrically insulating media, the chamber being provided with an opening normally closed in sealing manner by a resiliently biased shuttle piston which extends through the opening and is arranged to be engaged and axially urged back by the contact pin during insertion thereof to cause an electrical connection to be made with the contact means of the female part, the female part having first and second closed and separate chambers containing electrically insulating media and each provided with a respective opening, the openings being axially aligned and normally sealed by the shuttle piston extending therethrough, the second chamber being located within the first chamber and the contact means being located within the second chamber, wherein the normally sealed openings of the chambers are formed in respective front walls thereof, and wherein each chamber is provided in a side wall thereof with a flexible membrane arranged to permit variation of the respective chamber volume for effecting balancing of the media pressure in the respective chambers relative to the pressure outside the connector, the membrane of the second chamber being laterally inwardly spaced from the side wall of the first chamber.

2. An underwater electrical connector comprising male and female parts, the male part having a contact pin and the female part having contact means located in a chamber containing electrically insulating media, the chamber being provided with an opening normally closed in sealing manner by a resiliently biased shuttle piston which extends through the opening and is arranged to be engaged and axially urged back by the contact pin during insertion thereof to cause an electrical connection to be made with the contact means of the female part, the female part having first and second closed and separate chambers containing electrically insulating media and each provided with a respective opening, the openings being axially aligned and normally sealed by the shuttle piston extending therethrough, the second chamber being located axially inwardly of the first chamber and the contact means being located in the second chamber, wherein the first and second chambers share a common outer wall and the normally sealed openings of the chambers are formed in respective front walls thereof, each chamber being provided in its respective front wall with a flexible membrane arranged to permit variation of the respective chamber volume for effecting balancing of the media pressure in the respective chambers relative to the pressure outside the connector.

3. An underwater electrical connector comprising male and female parts, the male part having a contact pin and the female part having contact means within or inwardly of a chamber containing electrically insulating media, the chamber being provided with an opening normally closed in sealing manner by a resiliently biased shuttle piston which extends through the opening and is arranged to be engaged and axially urged back by the contact pin during insertion thereof to cause an electrical connection to be made with the contact means of the female part, wherein the female part has first, second and third closed and separate chambers containing electrically insulating media and each provided with a respective opening, the openings being axially aligned and normally sealed by the shuttle piston extending therethrough, the second chamber being located within or inwardly of the first chamber and the third chamber being located within or inwardly of the second chamber, and the contact means being located within the third chamber.

4. A connector as claimed in claim 3, wherein the male part has a plurality of contact pins and the female part has the same plurality of contact means, each contact means being separately enclosed by an individual third chamber.

5. An underwater electrical connector comprising male and female parts, the male part having a contact pin and the female part having contact means within or inwardly of a chamber containing electrically insulating media, the chamber being provided with an opening normally closed in sealing manner by a resiliently biased shuttle piston which extends through the opening and is arranged to be engaged and axially urged back by the contact pin during insertion thereof to cause an electrical connection to be made with the contact means of the female part, wherein the female part has first and second closed and separate chambers containing electrically insulating media, the second chamber being located within or inwardly of the first chamber and the contact means being located within or inwardly of the second chamber, each chamber being provided with a respective opening, the openings being axially aligned, and the shuttle piston extending through both said axially aligned openings so that both the openings are sealed by the shuttle piston when the female and male parts of the connector are disengaged from one another, and the contact pin of the male part extending through and sealing both said openings when the male and female parts are interengaged.

6. A connector as claimed in claim 5, wherein the shuttle piston is formed of electrically insulating material and extends through a female contact socket located within or inwardly of the second chamber, whereby the electrical connection is made by the contact pin pushing back the shuttle piston to be received and directly engaged by the contact socket.

7. A connector as claimed in claim 5, wherein the contact pin of the male connector part has a contact end for making said electrical connection with the contact means of the female part, and wherein the male connector part includes a slidably mounted wiper seal enagaging the contact pin and resiliently biased towards the contact end thereof, the seal being arranged to be moved back over the pin during mating of the male and female parts.

8. A connector as claimed in claim 5, including means for effecting balancing of the media pressure in the respective chambers relative to the pressure outside the connector.

9. A connector as claimed in claim 8, wherein each chamber has a wall formed at least partly of a flexible membrane arranged to permit variation of the respective chamber volume.

* * * * *